US007819791B1

(12) United States Patent
Ross

(10) Patent No.: US 7,819,791 B1
(45) Date of Patent: Oct. 26, 2010

(54) CARTONER FOR CARTONS HAVING CONCAVE SIDES

(75) Inventor: Paul John Ross, Cumming, GA (US)

(73) Assignee: Packaging Equipment Inc., Cumming, GA (US)

( * ) Notice: Subject to any disclaimer, the term of this patent is extended or adjusted under 35 U.S.C. 154(b) by 0 days.

(21) Appl. No.: 12/240,736

(22) Filed: Sep. 29, 2008

Related U.S. Application Data

(60) Provisional application No. 60/975,820, filed on Sep. 28, 2007.

(51) Int. Cl.
*B31B 1/78* (2006.01)

(52) U.S. Cl. ..... 493/319; 493/309; 493/121; 53/564

(58) Field of Classification Search ..... 493/309, 493/313–319, 121–128; 53/564, 566, 571, 53/579

See application file for complete search history.

(56) References Cited

U.S. PATENT DOCUMENTS 1,962,759 A * 6/1934 Bergstein ..... 493/311
3,527,367 A * 9/1970 Bivans ..... 414/798.9
3,538,679 A * 11/1970 Voorhis ..... 53/377.2
3,956,976 A * 5/1976 Vogel et al. ..... 493/315
4,018,143 A * 4/1977 Dice et al. ..... 493/131
4,160,406 A * 7/1979 Nowacki ..... 493/125
4,163,414 A * 8/1979 Bachman et al. ..... 493/181
4,232,591 A * 11/1980 Karpinsky ..... 493/314
4,348,853 A * 9/1982 Morse et al. ..... 53/566
4,518,301 A * 5/1985 Greenwell ..... 414/795.7
4,537,587 A * 8/1985 Langen ..... 493/315
4,578,054 A * 3/1986 Herrin ..... 493/126
4,596,545 A * 6/1986 Greenwell ..... 493/315
4,871,348 A * 10/1989 Konaka ..... 493/315
5,106,359 A * 4/1992 Lott ..... 493/125
5,155,968 A * 10/1992 Mosse et al. ..... 53/64
5,162,033 A * 11/1992 Wakabayashi et al. ..... 493/313
5,454,215 A * 10/1995 Martelli ..... 53/564
5,486,152 A * 1/1996 Heinz et al. ..... 493/468
5,613,828 A * 3/1997 Haddow et al. ..... 414/798.9
6,872,176 B2 * 3/2005 Wyss et al. ..... 493/55
6,955,032 B2 * 10/2005 Smith ..... 53/566
7,422,551 B2 * 9/2008 Monti ..... 493/309
2004/0023768 A1 * 2/2004 Jaen ..... 493/55

* cited by examiner

*Primary Examiner*—Paul R Durand
(74) *Attorney, Agent, or Firm*—Sentry Law Group; Steven P. Wigmore

(57) ABSTRACT

The cartoner has been designed to form cartons from blanks, whereby the formed cartons have tapered concave sides. A unique series of elements, including capture lugs which hold and "bow" the carton blank, together with plow rods and oscillators which have curved metal plates are used to "pre-break" the score lines of the blank. Travelling pressure blocks having convex outer surfaces are used to press the concave sides of the carton while hot glue dries, whereby the unique, tapered cartons are properly formed.

14 Claims, 30 Drawing Sheets

CARTONER FOR CARTONS HAVING CONCAVE SIDES

CROSS-REFERENCE TO RELATED APPLICATION

The present application is a continuation of provisional patent application Ser. No. 60/975,820 entitled Cartoner for Cartons Having Concave Sides, which was filed on Sep. 28, 2008, the contents and priority of which are claimed herein.

BACKGROUND OF THE INVENTION

The present invention relates to packaging equipment. In particular the invention relates to an apparatus and methods for forming, gluing, and filling preformed cartons, particularly cartons which have concave sides.

Current systems for handling products and packages, such as cartons, commonly to use conveyors to move and assemble cartons from blanks, and to then move and transfer products into the formed, glued cartons in an inline process. The conveyors typically include elements, such as carton or product lugs, chains, gears, oscillators, and the like, all of which are typically linked together by a drive system, such as a motor driven chain drive system. The various elements which comprise the packaging equipment combine to form a piece of apparatus called a "cartoner".

Typical cartoners are generally referred to as "horizontal" or "vertical" cartoners, the distinction being in the manner in which they operate, with horizontal cartoners typically being relatively long machines which are loaded with blank cartons at one end. As they move down the conveyor, the carton blanks are formed and glued into partially formed cartons which lie on their sides. Product is loaded into the partially formed cartons which are "horizontally" oriented, and then their flaps are tucked, glued, and sealed. The fully formed cartons, loaded with product, are then passed to a final station where they are removed for storage or shipping.

As is known by those familiar with the cartoner industry, some so-called "horizontal" cartoners, such as those made by Langen Packaging, Inc. of Mississauga, Canada, can also be "tilted" upwards to about forty-five degrees. Similarly, there are so-called "vertical" cartoners which form cartons from the blanks such that they have a vertical orientation when they are filled.

Each of the known prior art cartoners, whether horizontal, "tilted", or vertical, is designed to form a carton from a blank, tuck in (and glue) the various flaps, and provide an area (or station) at which a partially formed carton having an open end can be filled with product, either manually or automatically. After the partially formed cartons have been filled, cartoners typically provide a further area in which the remaining flaps of the filled carton are glued and sealed, and then, ultimately removed from the machine, manually or using a conveyor system, whereby fully formed cartons, filled with product, ultimately leave the cartoner.

Based upon their design and operation, cartoners are capable of handling the foregoing operation with up to several thousand cartons being formed and filled in every shift.

As is generally understood, a standard design for a carton is a generally rectangular box, such as those used for products found on the shelves of supermarkets and other stores, filled with everything from cereals to golf balls. A problem which has existed with the cartoners of the prior art, however, is that they are generally limited to handling cartons having only a limited type of shape, while recent market studies have shown that consumers perceive certain shapes, such as a tapered carton having concave sides, as being premium packages which contain premium products.

The heretofore known cartoners have been unable to form cartons from blanks which would provide the formed cartons with such tapered, concave sides.

DETAILED DESCRIPTION OF THE PREFERRED EMBODIMENTS

Figure 1:
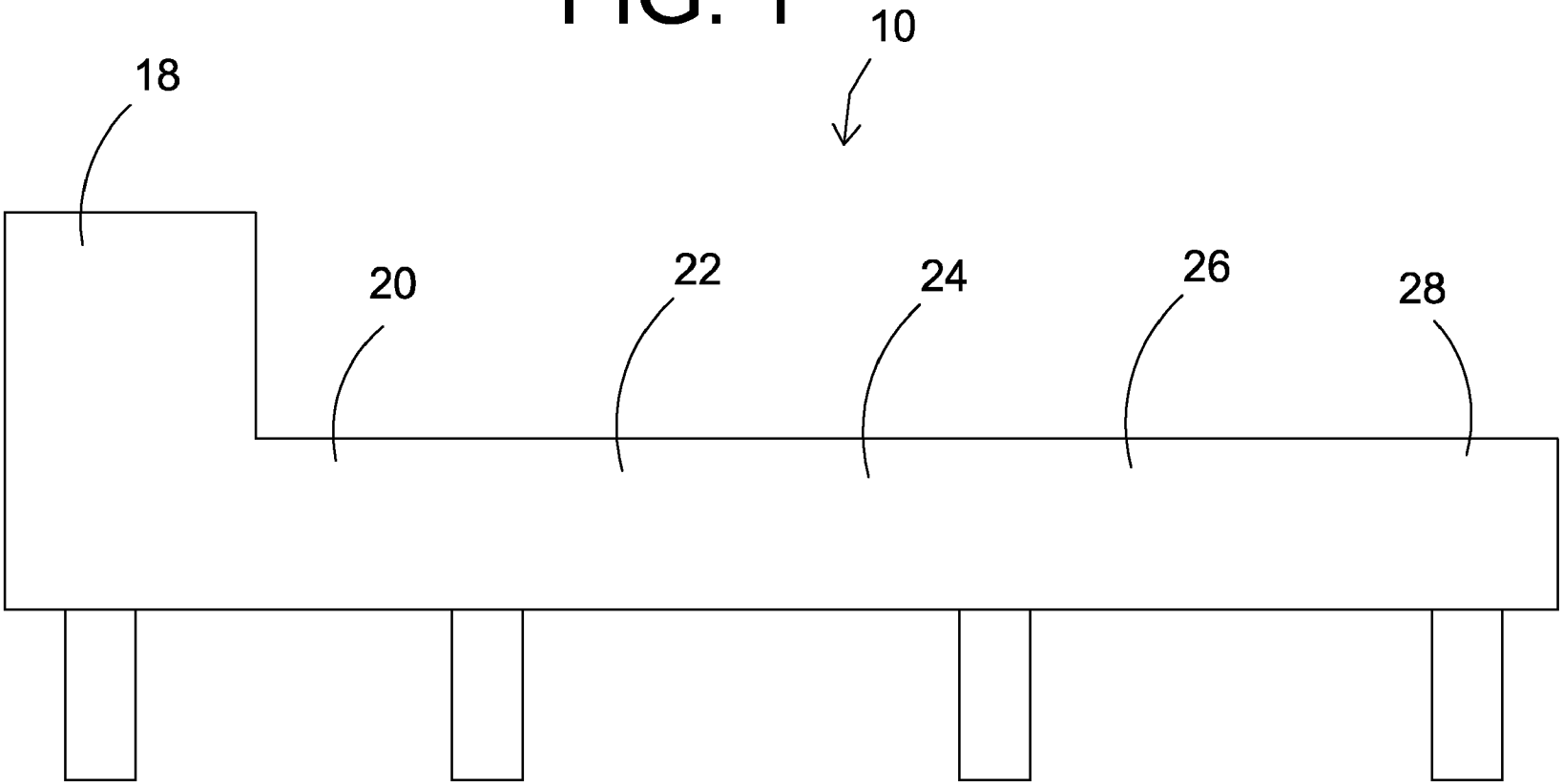
FIG. 1 is a side schematic view of the cartoner of the present invention.
Figure 2:
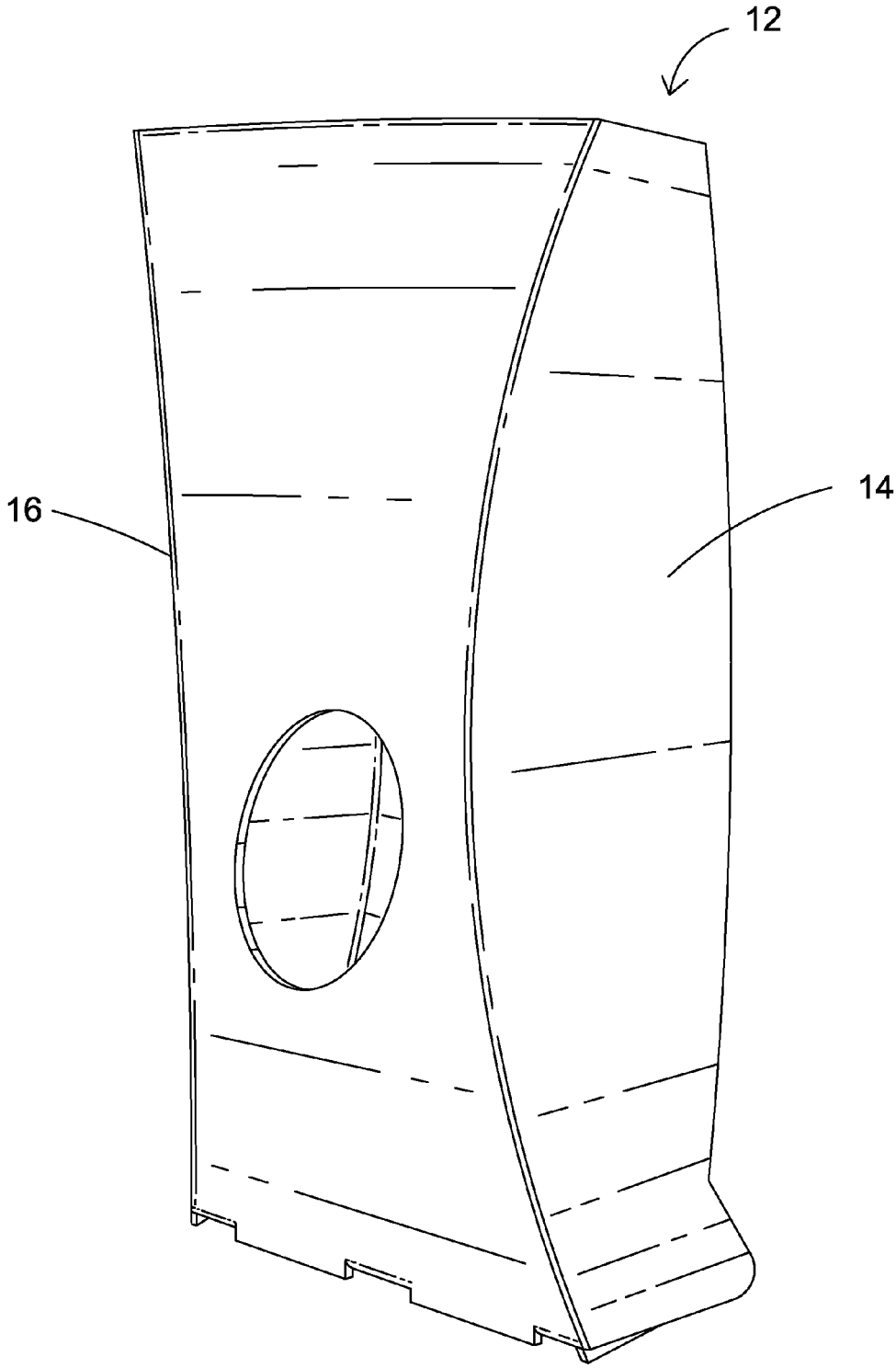
FIG. 2 is a perspective view of a "premium" carton having concave sides of the type which can be folded, formed, and filled using the present invention.

Referring first to FIGS. 1 and 2, the present invention is a new cartoner 10 which can be used to form, fill, and glue a carton 12 having concave (e.g., tapered) sides 14, 16 (See, FIG. 2). With continued reference to FIG. 1, the cartoner 10 of the present invention is an elongated apparatus which includes a loading area 18 at one end. The loading area 18 includes a magazine which holds a stack of preformed carton blanks. As those skilled in the art are aware, carton blanks are made by carton manufacturers who generally deliver the blanks in a collapsed form, whereby they can be stacked in a magazine located in the loading area 18 of the cartoner 10.

With continued reference to FIG. 1, the cartoner 10 includes means, located in the loading area 18, for removing individual collapsed blanks from the magazine and then moving them from the loading area 18, through a series of sections 20, 22, 24, 26, 28 of the cartoner 10 where the blanks undergo a series of operations. Thus, the cartoner 10 includes a section 20 in which the collapsed blanks are opened, and additional sections at which the flaps on one side of the blanks are closed 22, at which product is inserted into the partially completed carton 24, at which the remaining flaps are closed and glued 26, and a section 28 at which completed, filled cartons are removed for storage and shipping.

Figure 3:
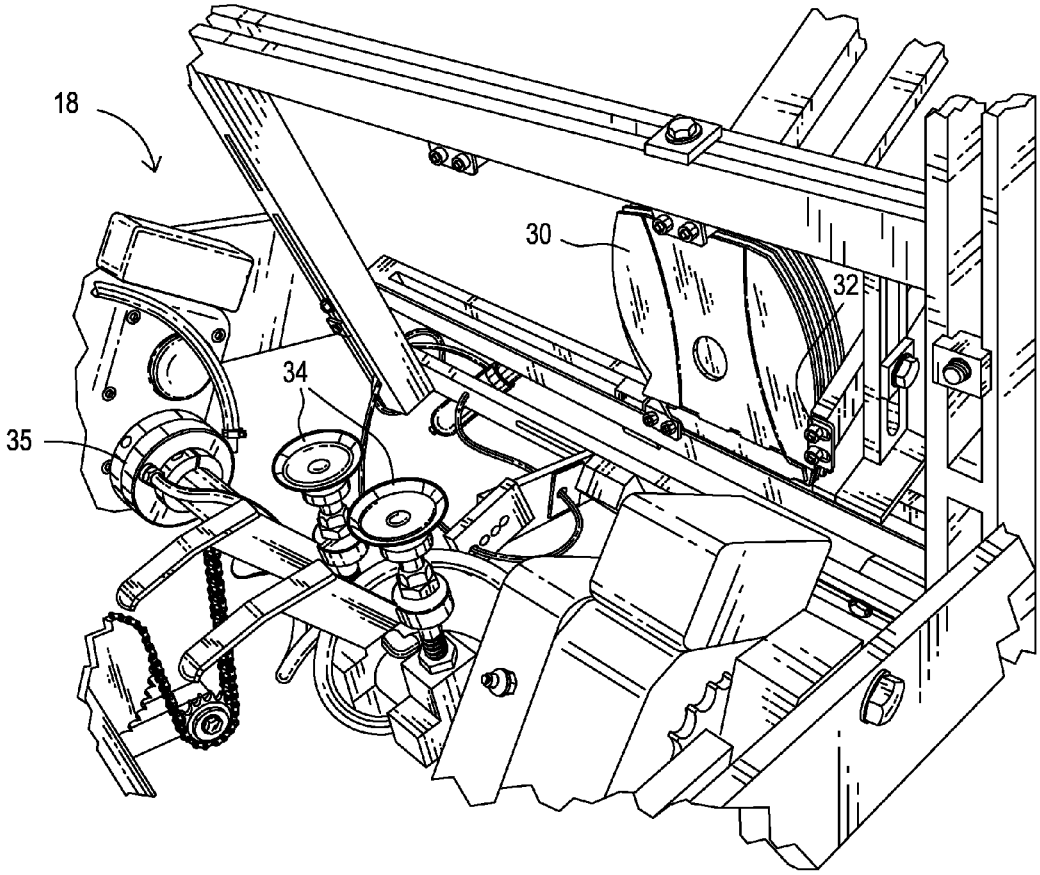
FIGS. 3-30 are perspective views showing the invention of FIG. 1 producing the carton of FIG. 2.

Referring, now, to FIG. 3, as is generally known in the art, the blanks 30 which are used to form the cartons 12 (See, FIG. 2) have already been cut, scored, adhesively bonded, and folded flat before they are placed into the magazine 32 at the loading area 18 of the cartoner 10. From there, individual blanks 30 are pulled from the magazine 32 using rotating vacuum sucker cups 34 which are mounted on a rotating, articulating apparatus 35, designed to reach out, and grab, a single preformed carton blank 30 at a time.

Figure 4:
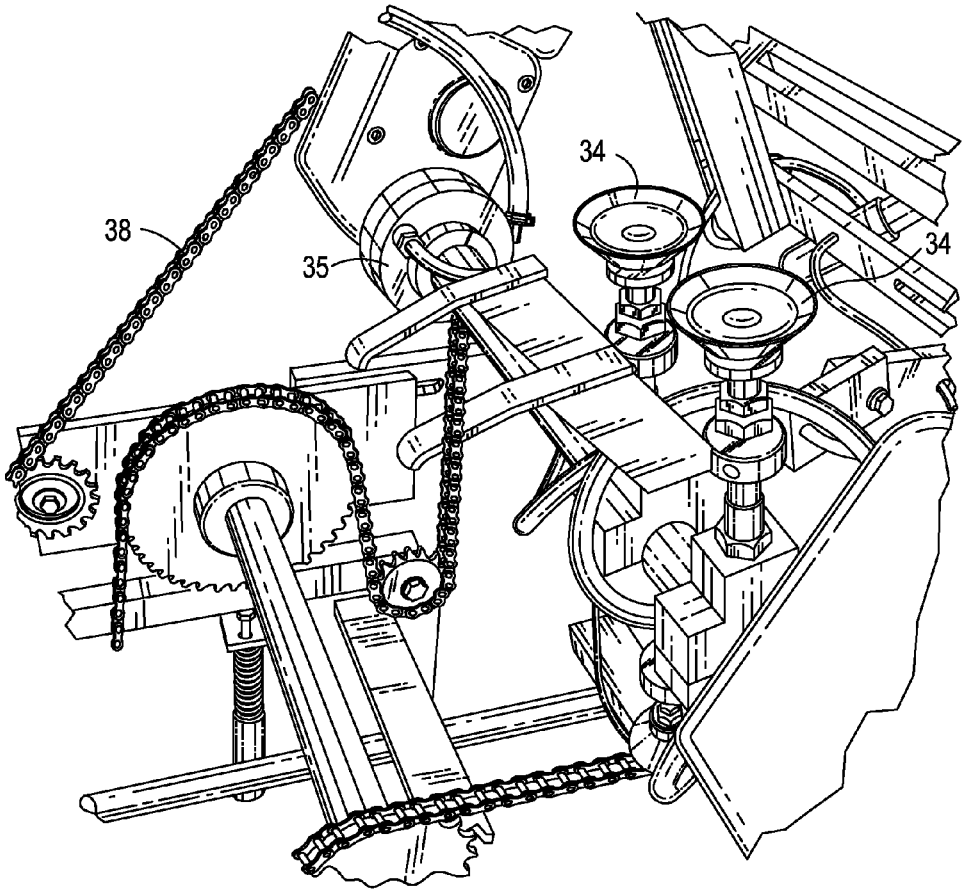
Figure 5:
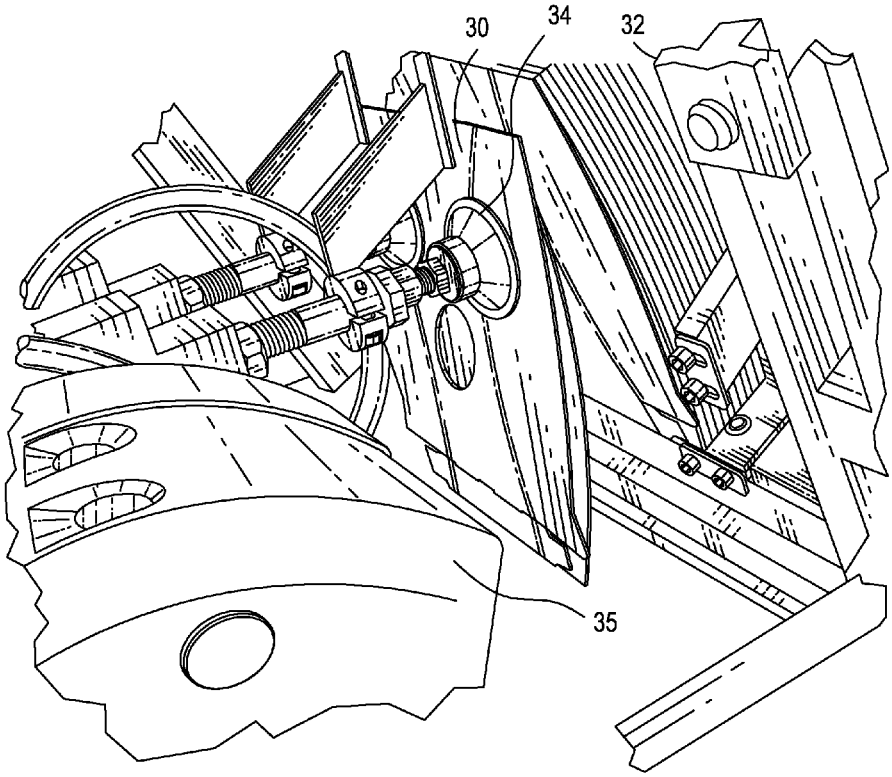

With reference to FIGS. 4 and 5, the vacuum sucker cups 34 are driven and rotated by a system, such as an electrically operated motor (not shown) which drives a chain 38 to insure that the movements of the various elements of the cartoner 10 are synchronized. The spacing of the carton blanks 30, as they are fed from the magazine 32 is determined by the "pitch" of the cartoner 10. Thus, a typical cartoner will generally have a predetermined "pitch", meaning that a carton blank 30 will follow (and be followed by) the next adjacent carton blank 30, with the blanks separated by the "pitch" length from one another. Within the "pitch" known cartoners have so-called "lugs" which receive and retain the carton blanks 30 as they pass from the loading end 18 of the cartoner 10 to the "filled" end 28.

The way the cartoner 10 of the present invention is able to accomplish the loading and sealing of a carton 12 having concave sides 14, 16 requires numerous modifications to "standard" cartoner machines. In the following explanation of the present invention, a "horizontal" cartoner machine is described, although those skilled in the art will, of course, recognize that the invention is not limited solely to horizontal cartoners.

Figure 6:
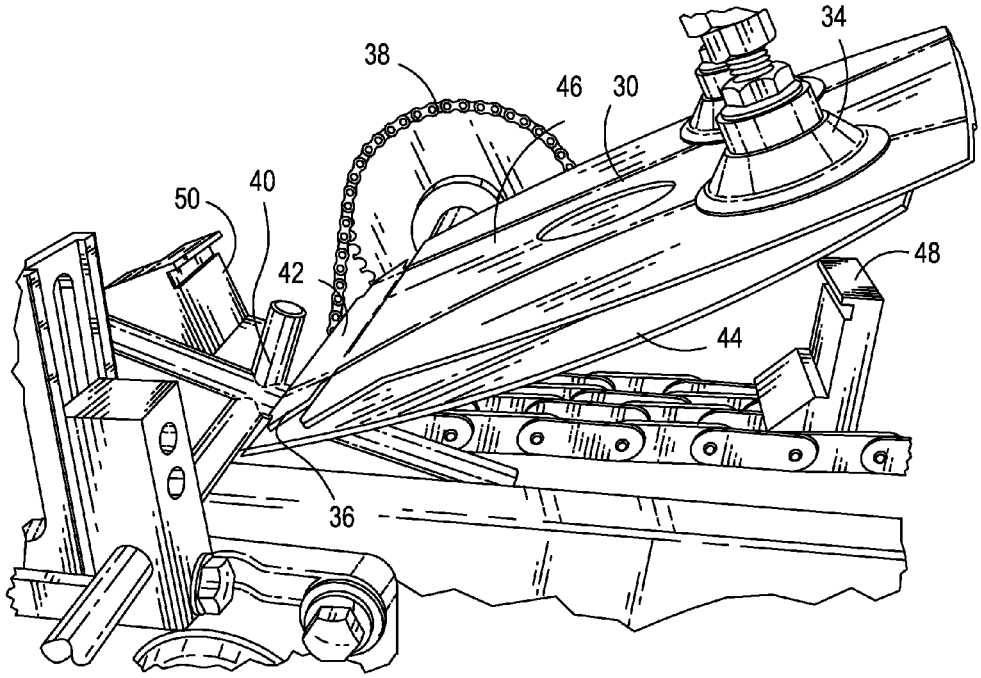
Figure 7:
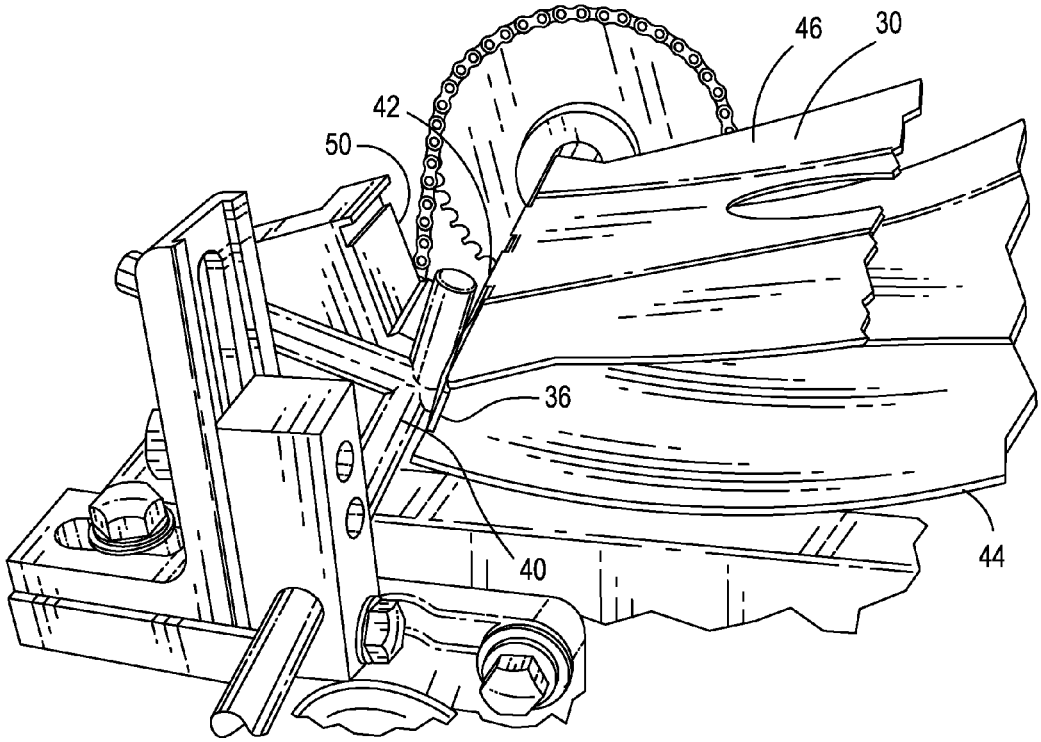

With reference to FIGS. 5-7, in the cartoner 10 of the present invention, as well as in standard, horizontal cartoning machines, after the vacuum sucker cups 34 grab an individual blank 30 from the magazine 32, they move the trailing edge 36 of the blank 30 (e.g., the scored edge between the bottom 42 of the carton blank 30 and the rear 44 of the carton blank 30) against a bar 40 which traps the blank 30, whereby further relative movement of the blank 30 toward the bar 40 (as the vacuum sucker cups continue to rotate toward the left, as shown in FIG. 6) causes the carton blank 30 to open from the original flattened position it had in the magazine 32 to a more "carton-like" position in which the front 46 and rear 44 of the blank 30 are spaced apart, as shown in FIG. 7.

Figure 10:
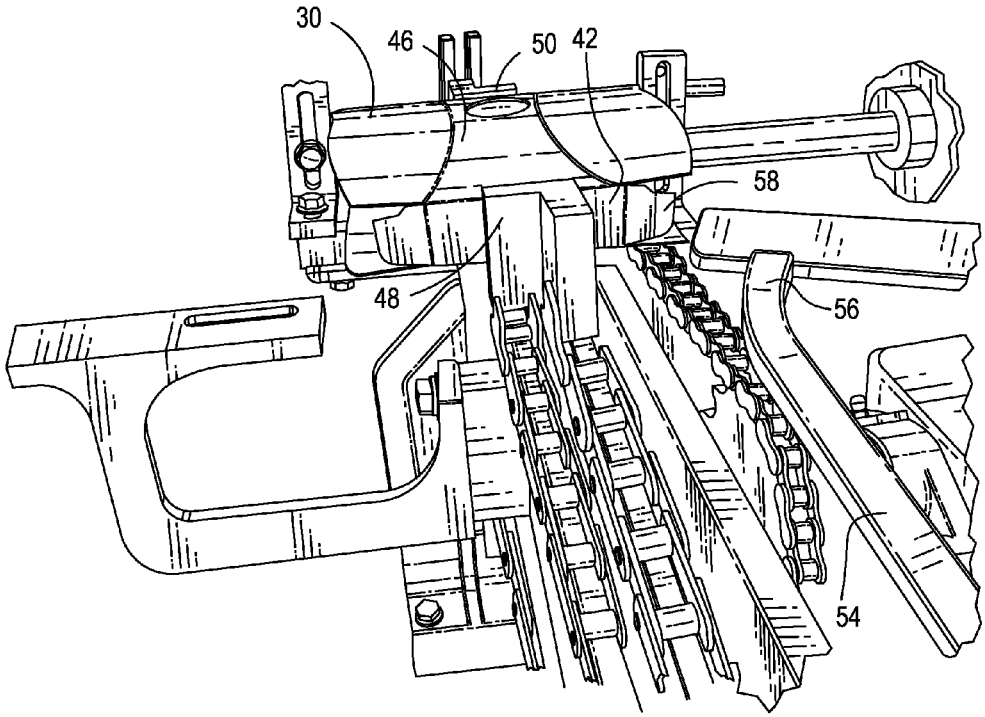
Figure 11:
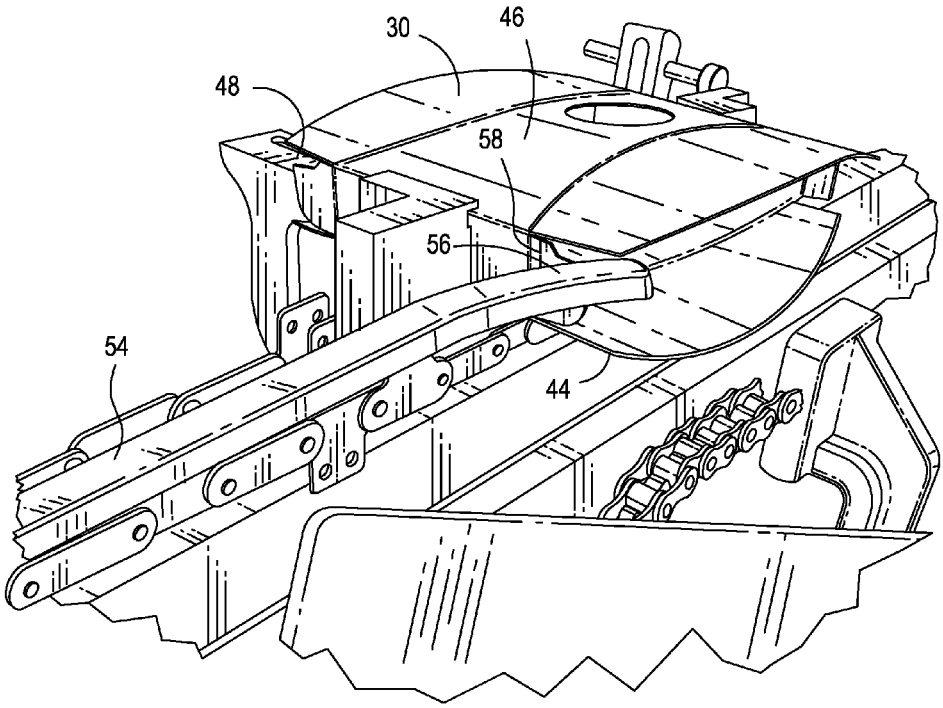

At the same time, the blank 30 is positioned between a leading capture lug 48 and a trailing capture lug 50 (See, FIGS. 6-9). While "standard" cartoners also use lugs, those lugs are generally rectangular in cross-section, whereas the "capture lugs" 48, 50 of the present invention are formed such that they are able to both hold the blank 30 therebetween and to squeeze the blank 30 to bow its front 46 upward and its rear 44 downward as shown in FIGS. 10-11. In the preferred embodiment of the invention, immediately before the trailing edge 36 of the blank 30 is placed into the rear capture lug 50, the trailing edge 36 is pressed against an angled bar 40 (See, FIG. 7) which urges the blank 30 to open up as the rear capture lug 50 approaches it.

Figure 8:
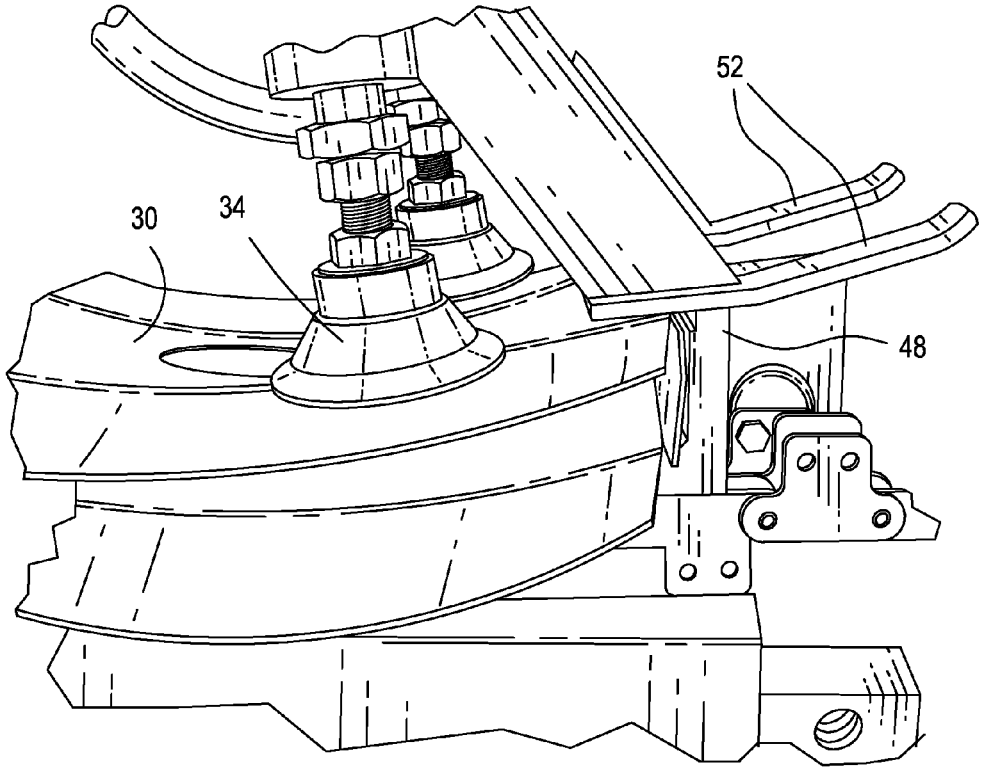
Figure 9:
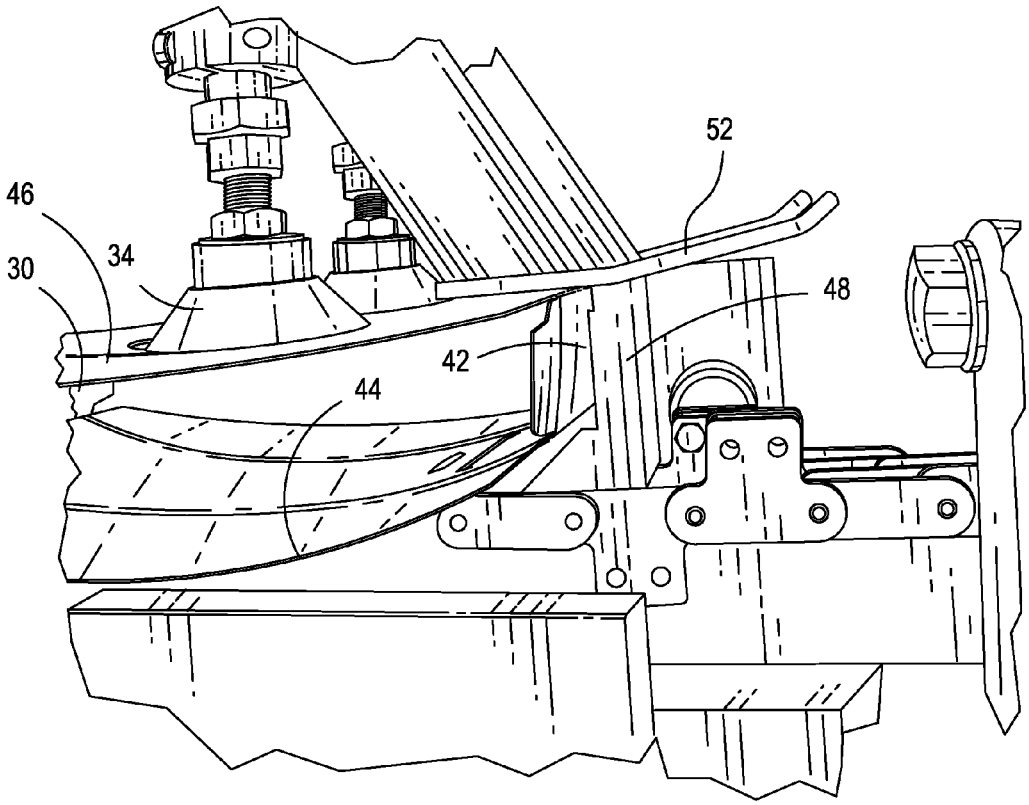

The vacuum sucker cups 34 urge the leading edge of the blank 30 into the leading capture lug 48 until it is fitted into the leading capture lug 48 as shown in FIGS. 8-9. In the preferred embodiment of the invention, rails 52 (See, FIGS. 8-9) assist in holding the leading edge of the blank 30 down as it is urged into position within the leading capture lug 48. With the blank 30 fully retained by the capture lugs 48, 50, the blank 30 will be somewhat "bowed", as shown in FIGS. 10-11, the importance of which will hereafter be made clear.

Figure 12:
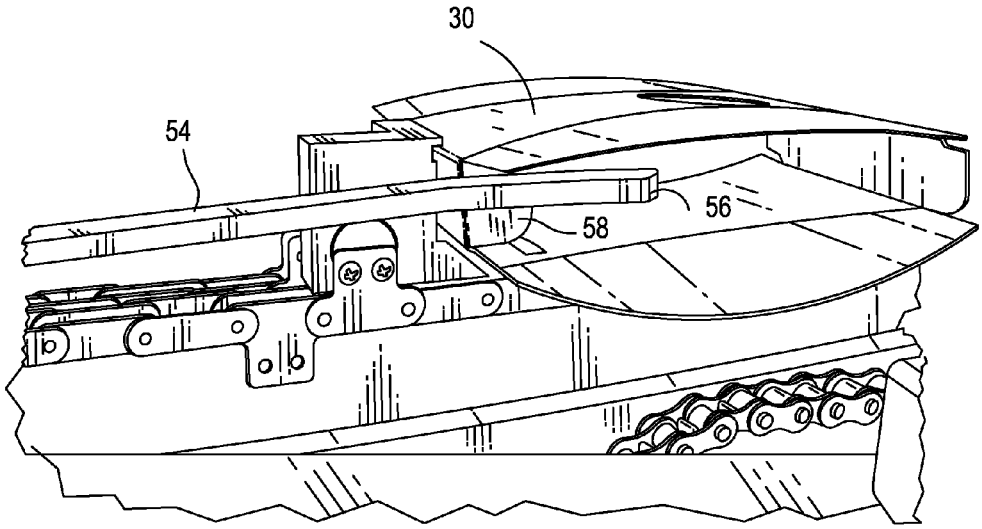

With reference to FIG. 10, the bowed blank 30 next approaches a first plow rod 54 which has an angled end 56. As the leading distal minor flap 58 of the blank 30 makes contact with the angled end 56 of the plow rod 54, the angled end 56 of the plow rod 54 urges the leading distal minor flap 58 to bend and close, as shown in FIGS. 11-13.

Figure 13:
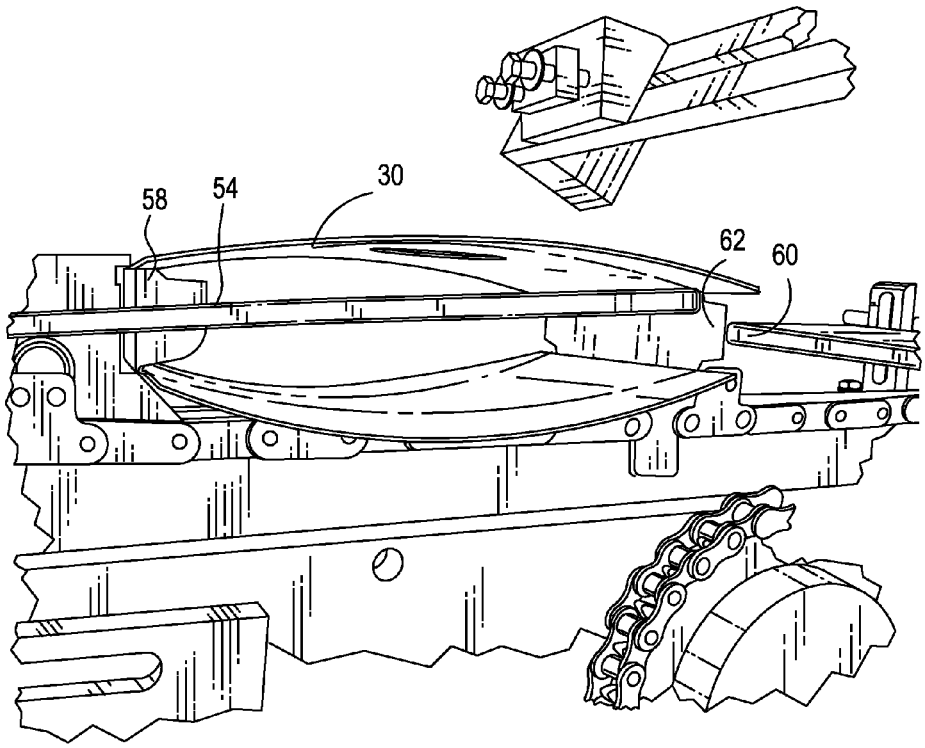
Figure 14:
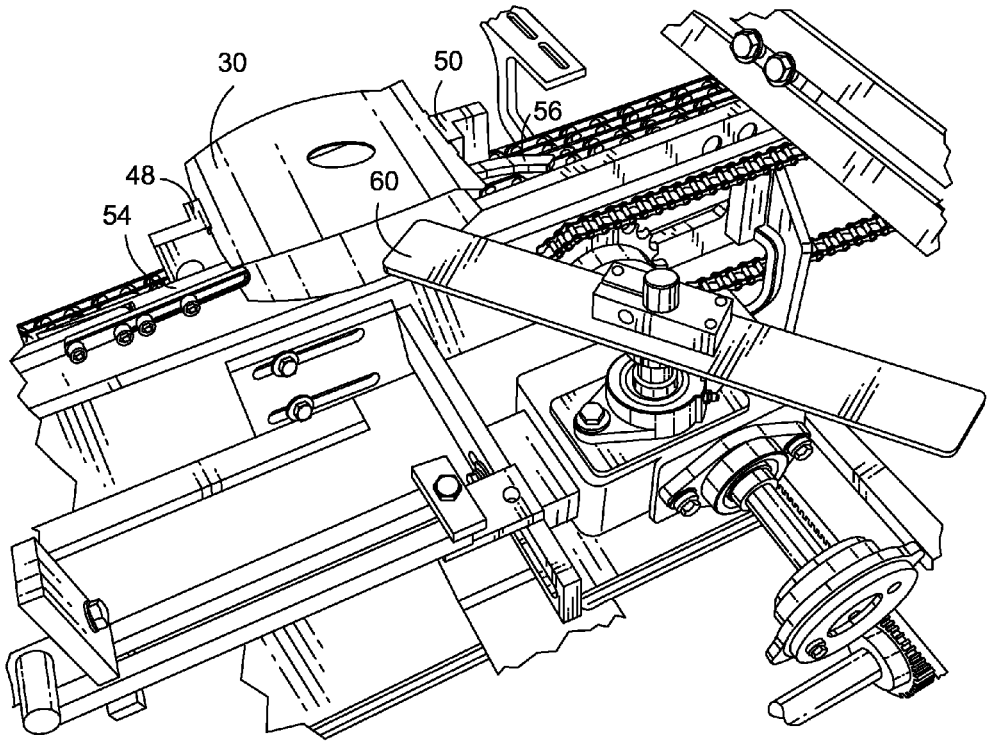

Referring to FIGS. 13-14, as the blank 30 moves further, a rotating rotary minor flap tucker 60, which rotates in a counterclockwise manner when viewed from above, makes contact with, and urges the closure of, the trailing distal minor flap 62. As will be understood by those skilled in the art, the movement of the blank 30 along the path of the cartoner 10 allows the stationary plow rod 54 to close the leading distal minor flap 58, as the closure of the rear leading distal minor flap 58 is toward the bottom of the carton 12. To close the trailing distal minor flap 62, on the other hand, requires that the flap 62 be closed toward the inside of the carton 12. Accordingly, the rotary minor flap tucker 60 has to rotate toward the leading edge of the carton blank 30, and it must do so at a speed greater than the speed at which the blank 30 is moving along the cartoner 10.

Figure 15:
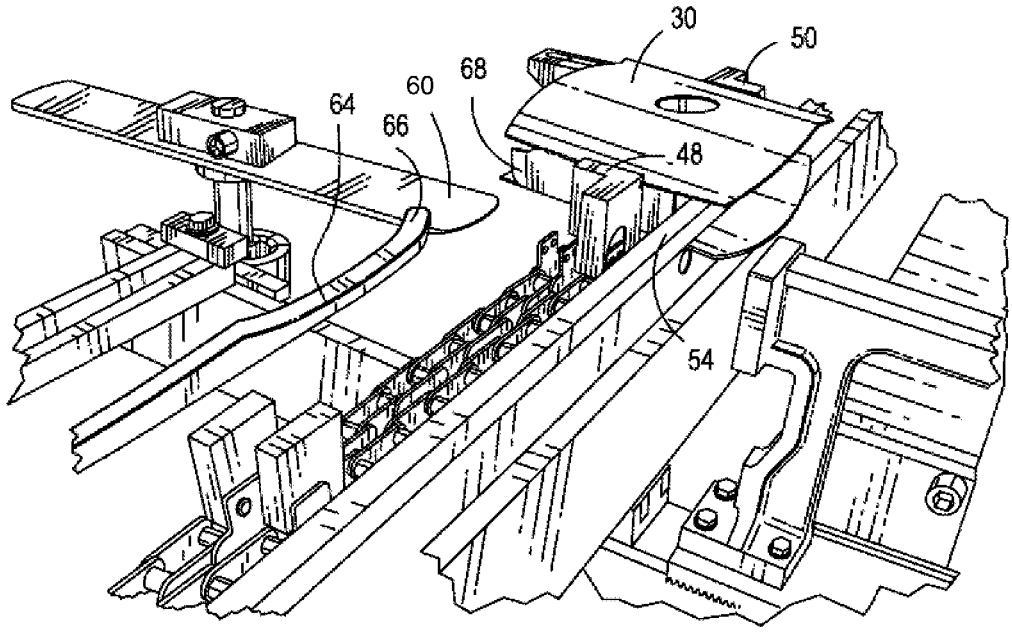

As the blank 30 continues to move, the elongated plow rod 54 holds both the rear leading and the rear trailing minor flaps 58, 62 closed, as shown in FIGS. 14-15. As will be understood by those skilled in the art, the vertical heights of the plow rod 54 and the rotary minor flap tucker 60 must be offset somewhat, whereby the rotating rotary minor flap tucker 60 does not strike the plow rod 56. This displacement allows the plow rod 54, which had closed the rear leading minor flap 58 to also receive the now closed rear trailing minor flap 62, thereby holding both rear minor flaps 58, 62 in the closed position shown in FIGS. 14-15. At this point product can be inserted into the partially completed carton.

Figure 16:
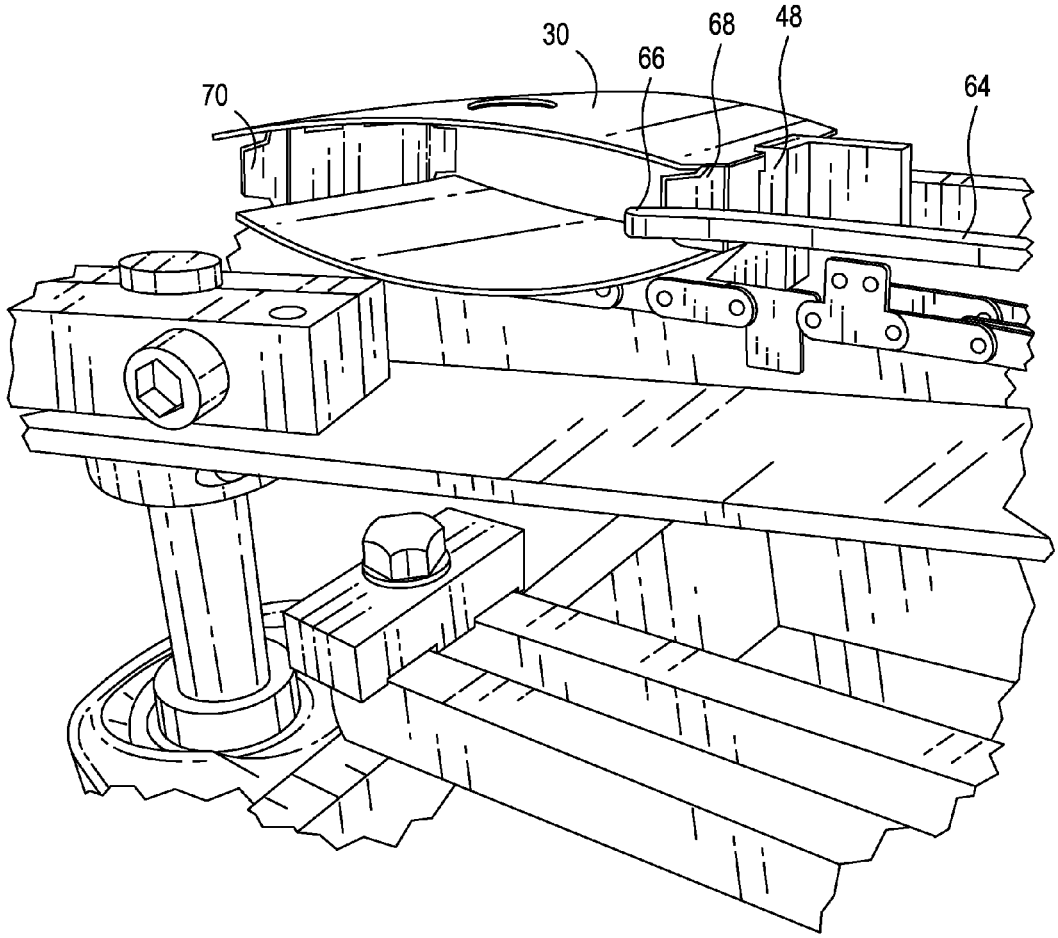
Figure 17:
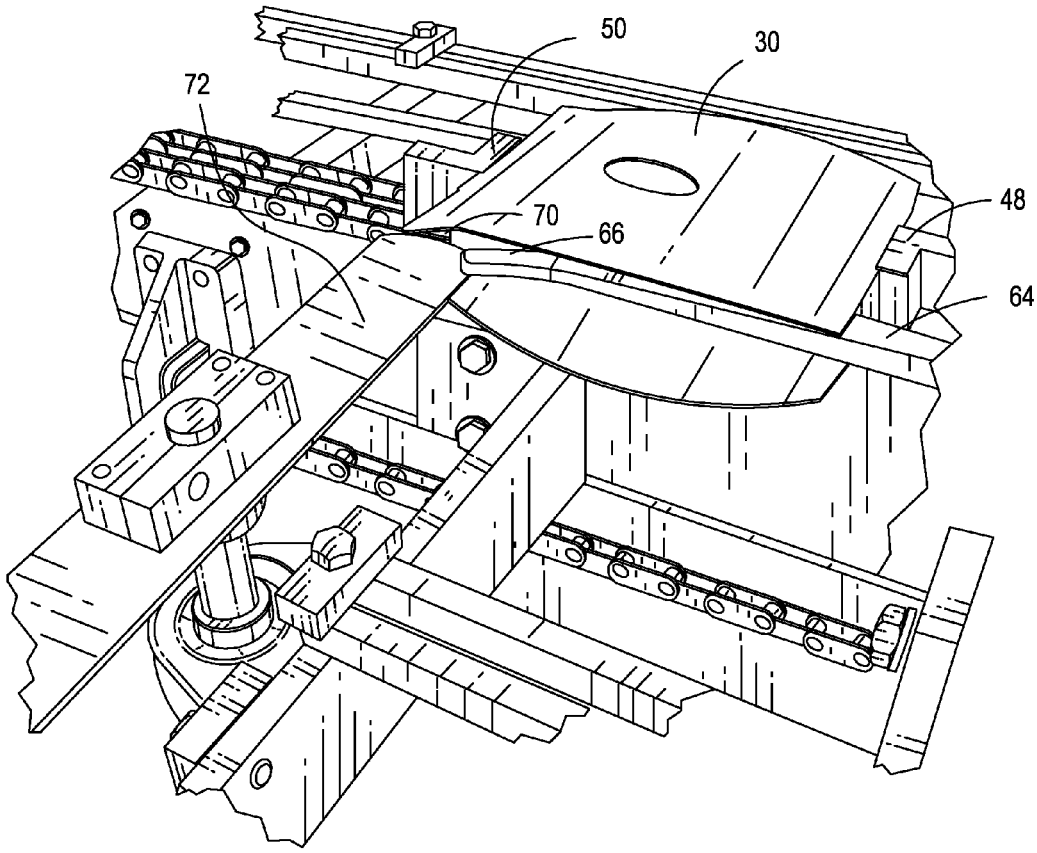

Referring next to FIGS. 15-17, the blank 30 approaches another plow rod 64 which also includes an angled portion 66, so that when the front leading minor flap 68 reaches the angled portion 66 of the plow rod 64, as shown in FIGS. 15-16, contact with the angled portion 66 of plow rod 64 closes the front leading minor flap 68. This is followed shortly thereafter by the closure of the front trailing minor flap 70 by another rotating rotary minor flap tucker 72, as shown in FIG. 17.

Figure 18:
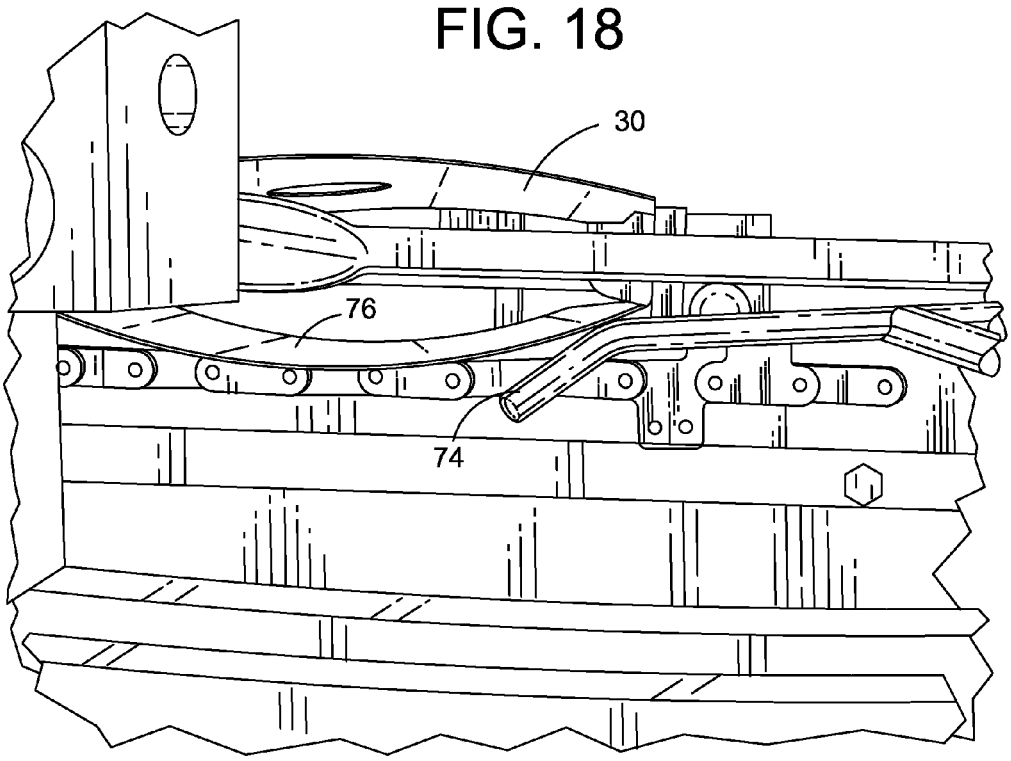
Figure 19:
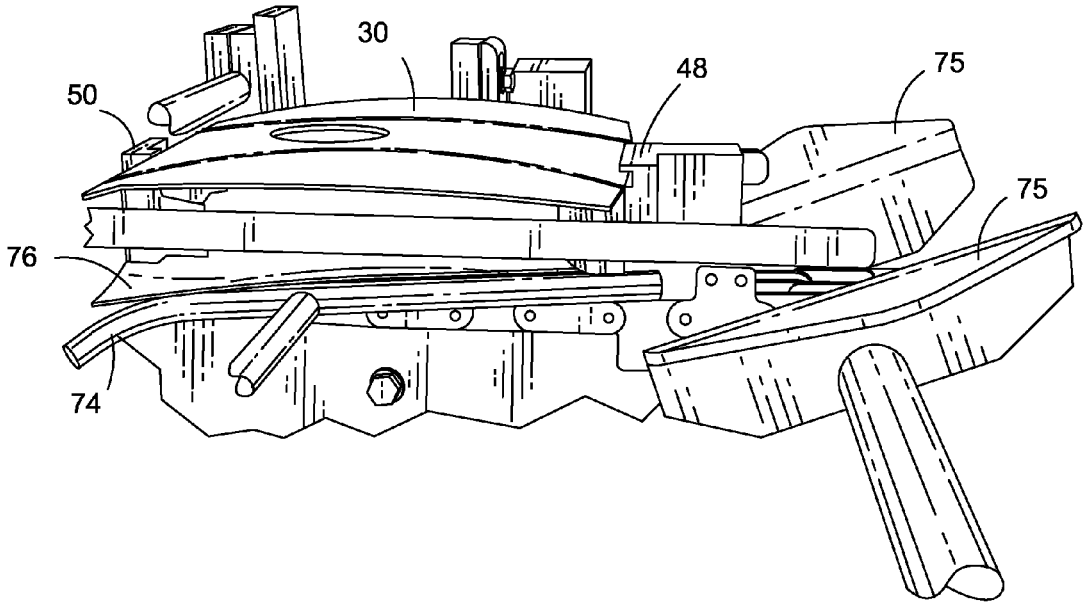
Figure 20:
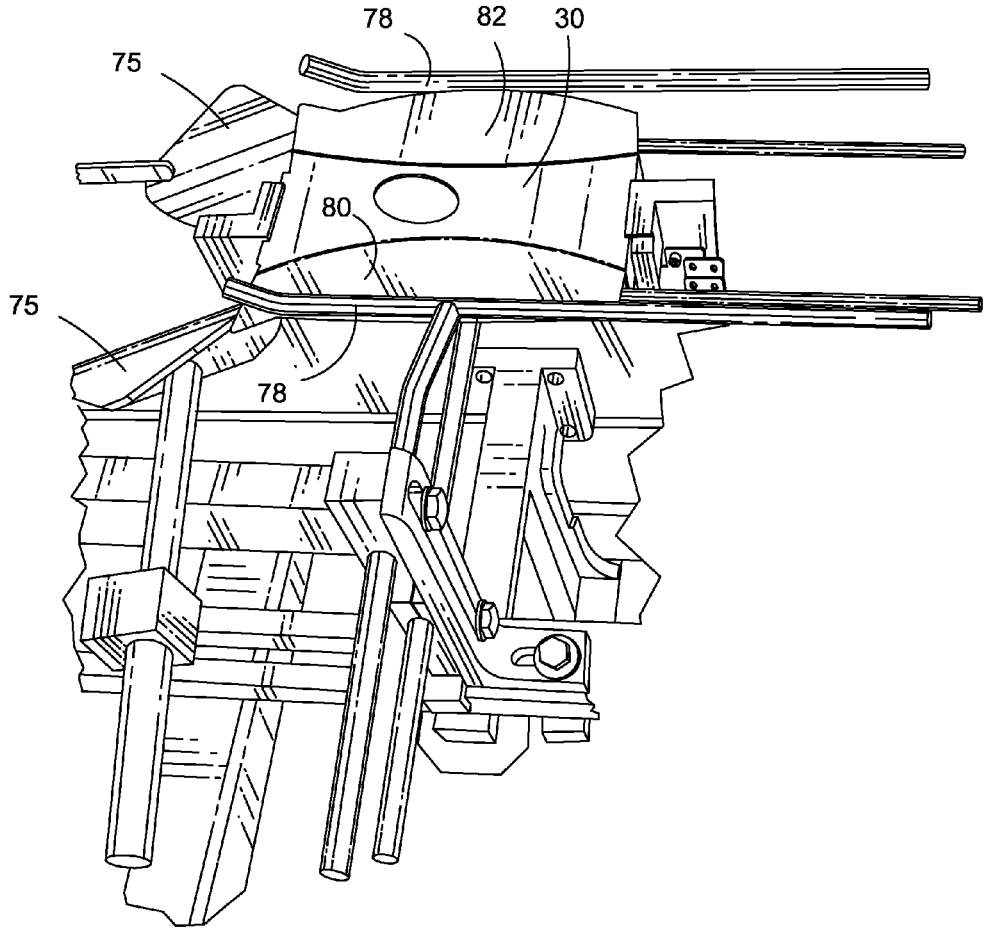
Figure 21:
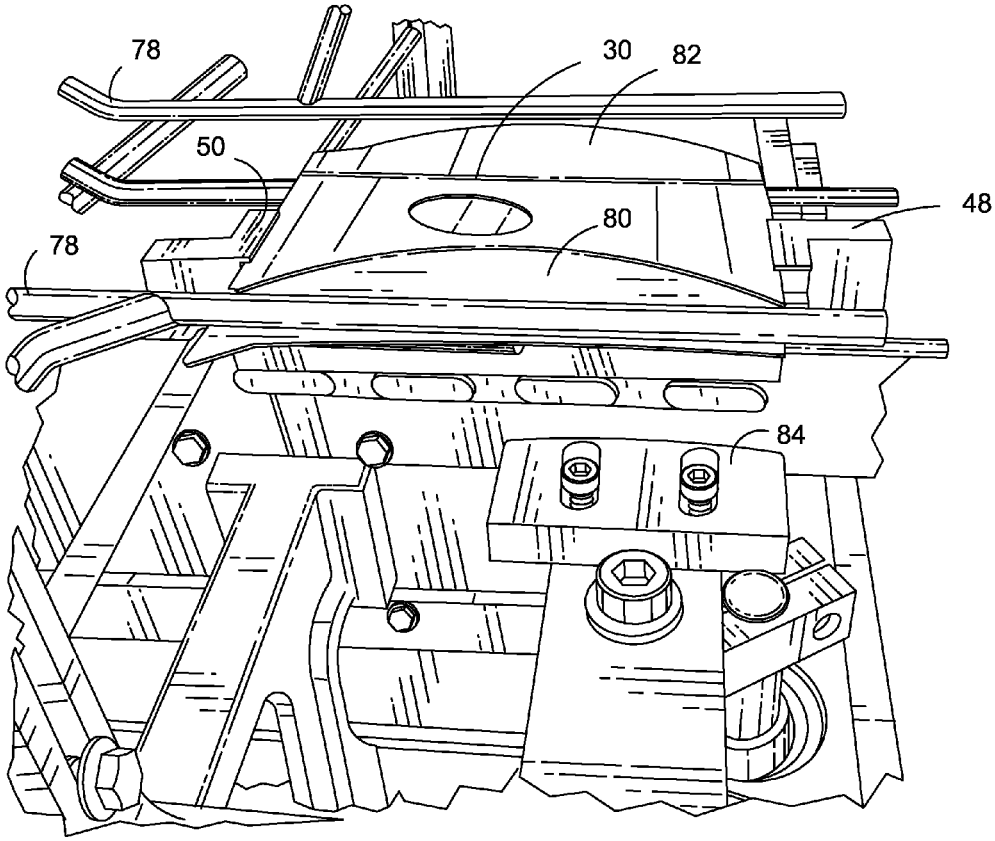
Figure 22:
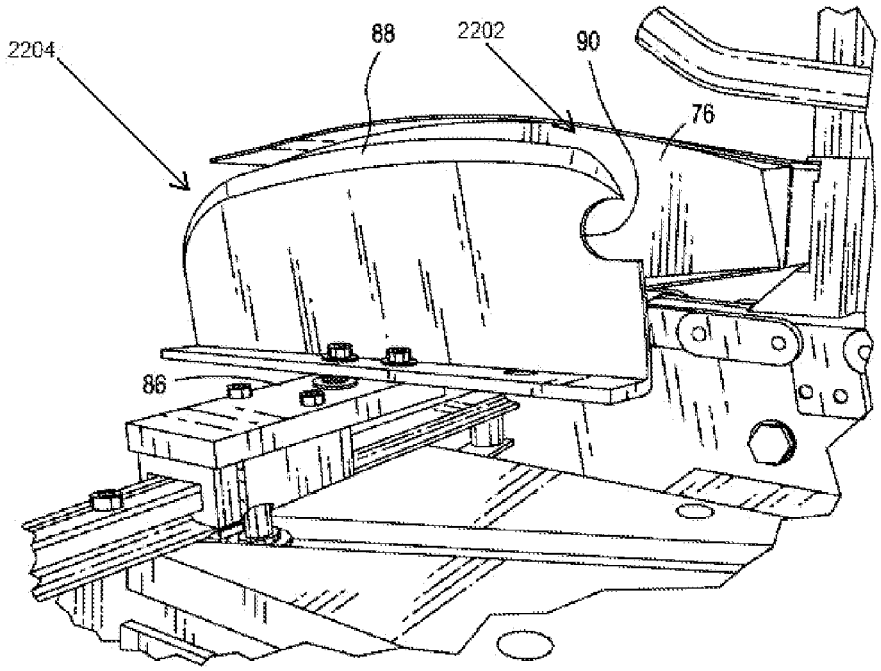

With reference to FIGS. 18-22, the blank 30 next undergoes a series of "pre-breaking" processes in which the major flaps of the blank 30 (corresponding to the sides 14, 16 of the carton 12) are flexed sufficiently to cause them to bend at their score lines when subsequent bending operations are conducted. These "pre-breaking" steps are key to the successful closure of the carton, as they soften the blank 30 along the curved score lines which give the carton 12 its concave sides 14, 16 (See, FIG. 2). The pre-breaking processes are accomplished by using lower secondary plow rods 74 to shape the lower inside major flaps by bowing them. As shown in FIGS. 18-19 a lower secondary angle plow 74 urges the front inside major flap 76 up as the blank 30 moves into its leading edge. A second set of plow plates 75 continues to close inside major flaps 76, when they reach the plates 75. Similarly, a lower secondary angle plow 74 (not shown) and plow plate 75 on the rear side urges the rear inside flap up. Next, upper secondary angle plows 78 are used to pre-break and retain the front and rear upper flaps 80, 82 of the blank 30 inside capture lugs 48, 50, as shown in FIG. 20.

Then, the partially formed carton blank 30 passes through a section of the cartoner 10 in which the inner major flaps 76 undergo a pre-breaking process while oscillators 84, which move with the blank 30 on each side (See, FIG. 21) press inward and urge the major inner flaps into position creasing at the score line of the blank 30. Once the lower major inner flaps are positioned, another set of cam track oscillators 86 which have curved metal cam operated pusher carton pre-break plates 88 (See, FIG. 22) hold the major inside flaps closed. As illustrated, the pusher carton prebreak plates 88 have curved cutouts 90 (See, FIGS. 22-23) to prevent interference with the rods which will fit into position. The prebreak plates 88 also have a gradual curved edge that may support a carton blank 30 along the at least one curved score line of the carton blank 30 while the carton blank 30 is being pre-broken over the gradual curved edge. The gradual curved edge may include first and second end portions 2202 and 2204, respectively, and a central portion near reference numeral 88. The first and second end portions 2202, 2204 may have a curve angle which is generally greater than a curve angle of the central portion.

Figure 23:
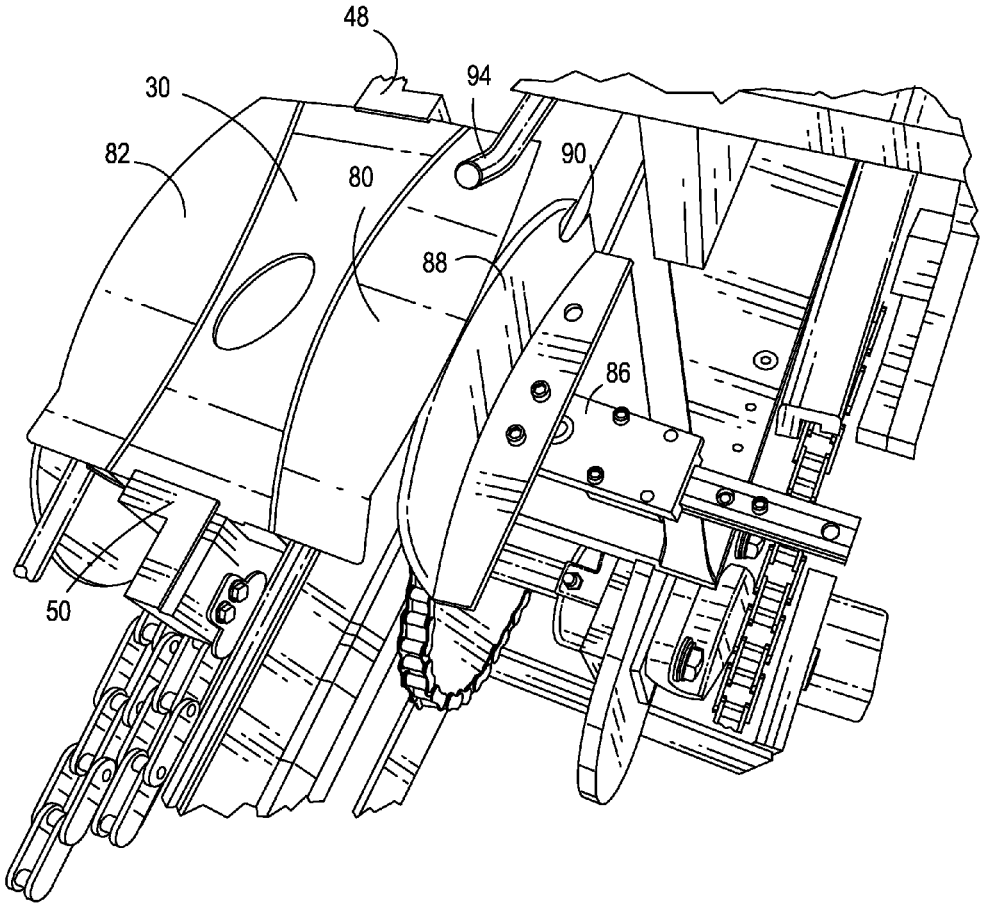
Figure 24:
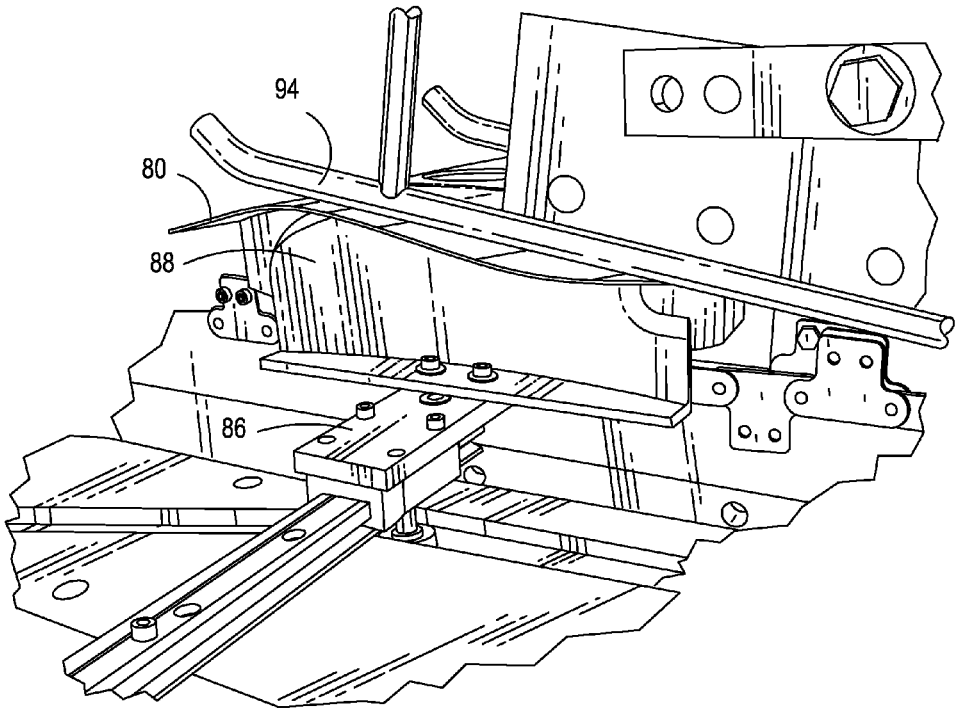
Figure 25:
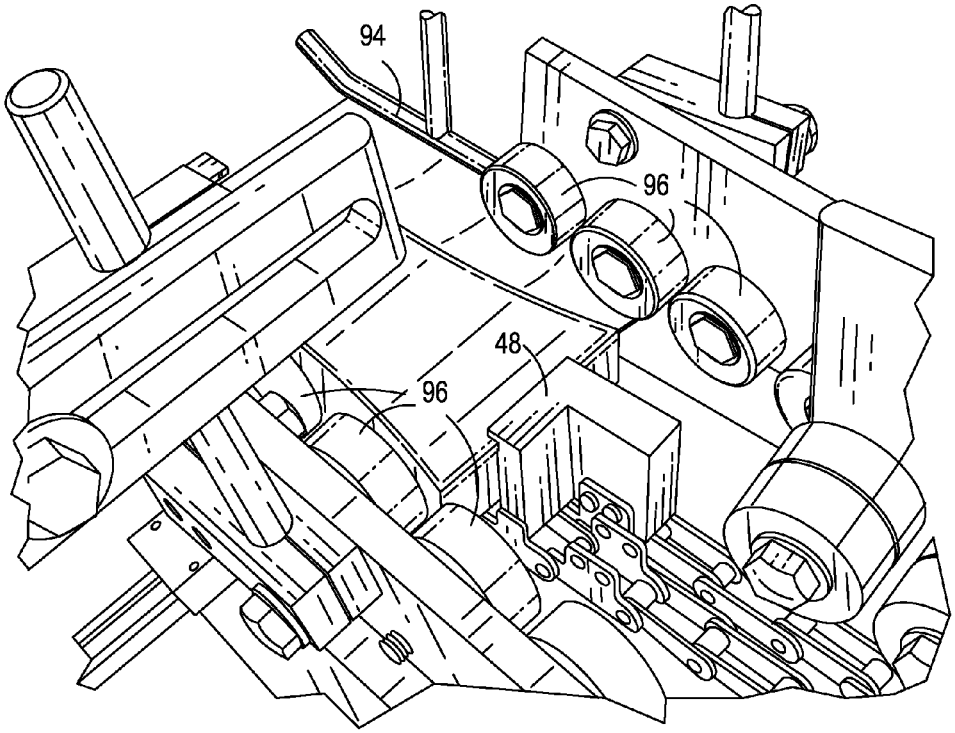
Figure 26:
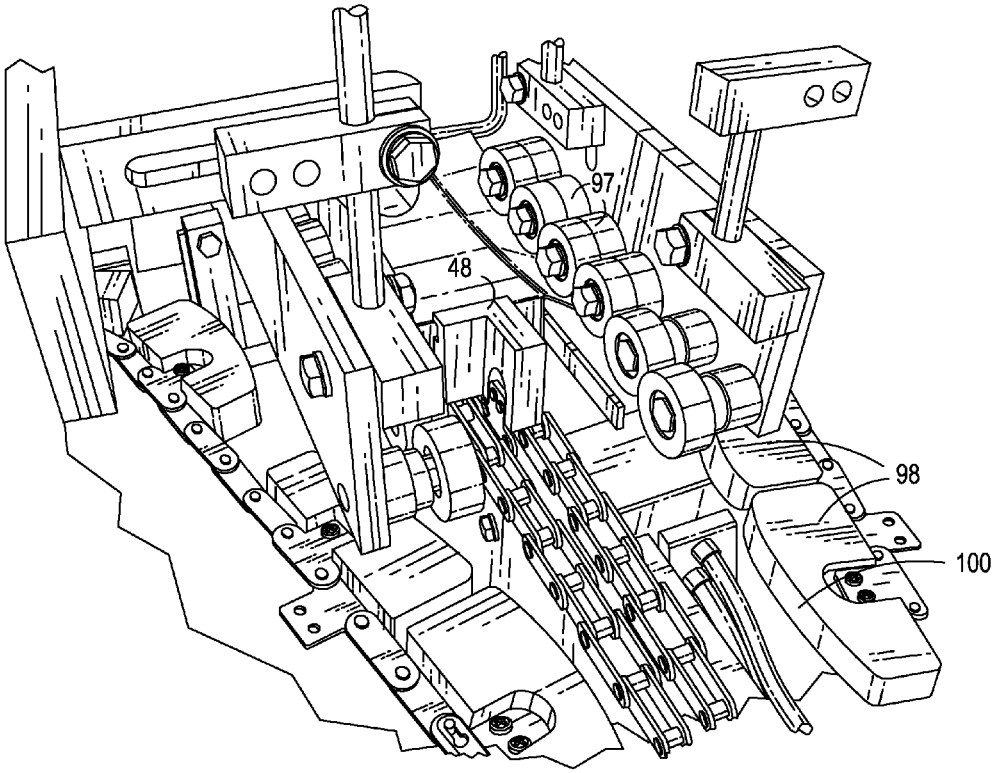
Figure 27:
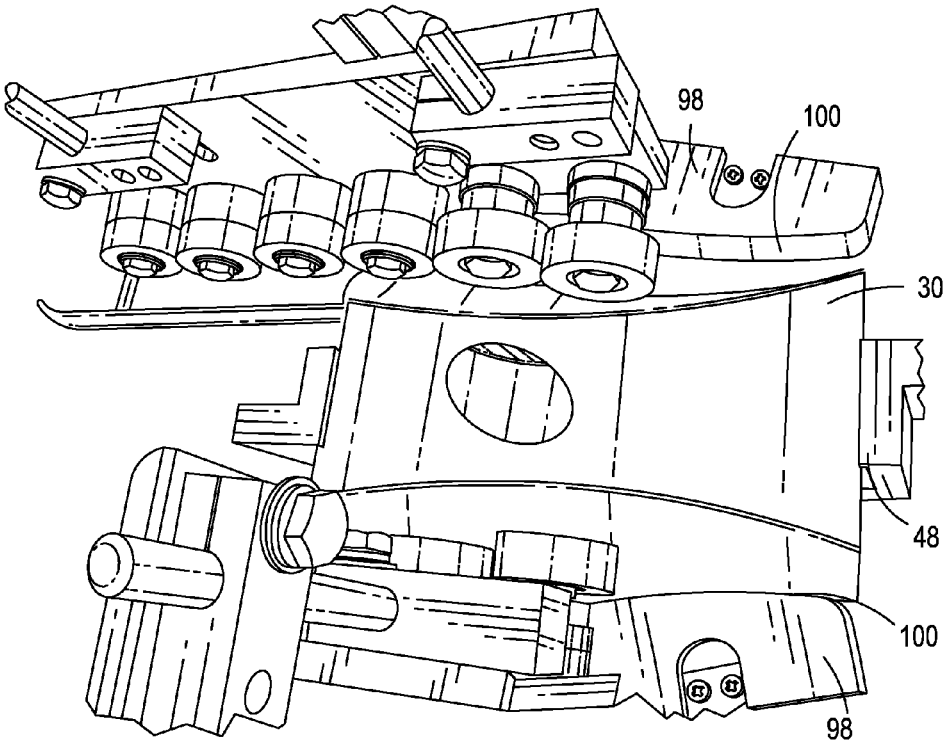
Figure 28:
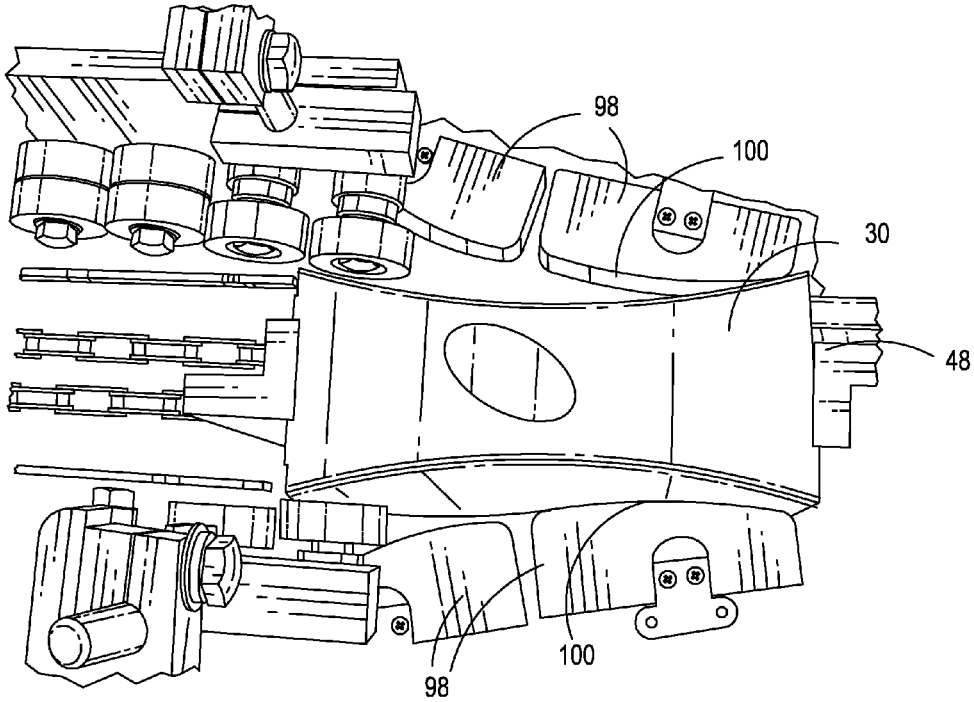
Figure 29:
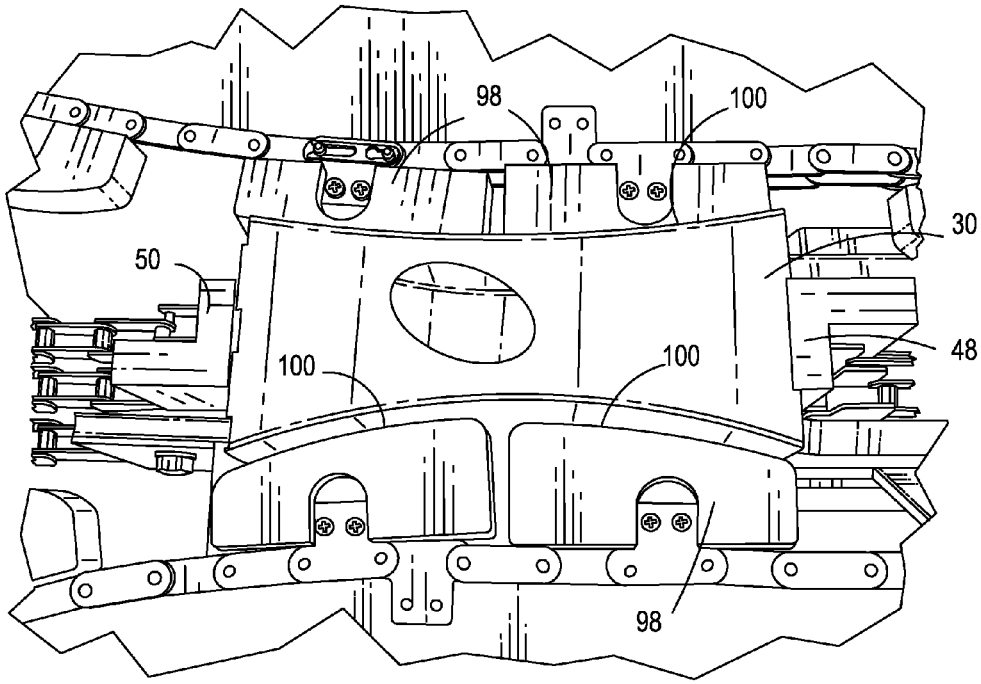

Next, the major outer flaps 80, 82 are pre-broken over the top of the carton pre-break plates 88 using rods 94, as shown in FIGS. 23-24. With the score lines of the carton blank 30 all having been "pre-broken", the major outer flaps are urged into their final position as shown in FIG. 25, by rollers 96 which are used to fully form the major flap score lines while avoiding any "marking" of the carton blank 30.

Then the outside major flaps 80, 82 are released from the rollers 96. The curved metal cam operated pusher pre-break plates 88 pull away from the carton blank 30 thereby reopening pre-broken outside major flaps 80, 82. Rods fit into position through cutouts 90, thereby holding the inside major flaps 76 closed.

Finally, glue (typically hot melted glue) is applied to the flaps, and the outer major flaps are reclosed by rods and rollers 97 and held in position by traveling pressure blocks 98 while the hot glue sets. As shown in FIGS. 26-30, the pressure blocks 98 have convex outer faces 100 to fit, and mate with, the concave sides 14, 16 of the carton 12.

Figure 30:
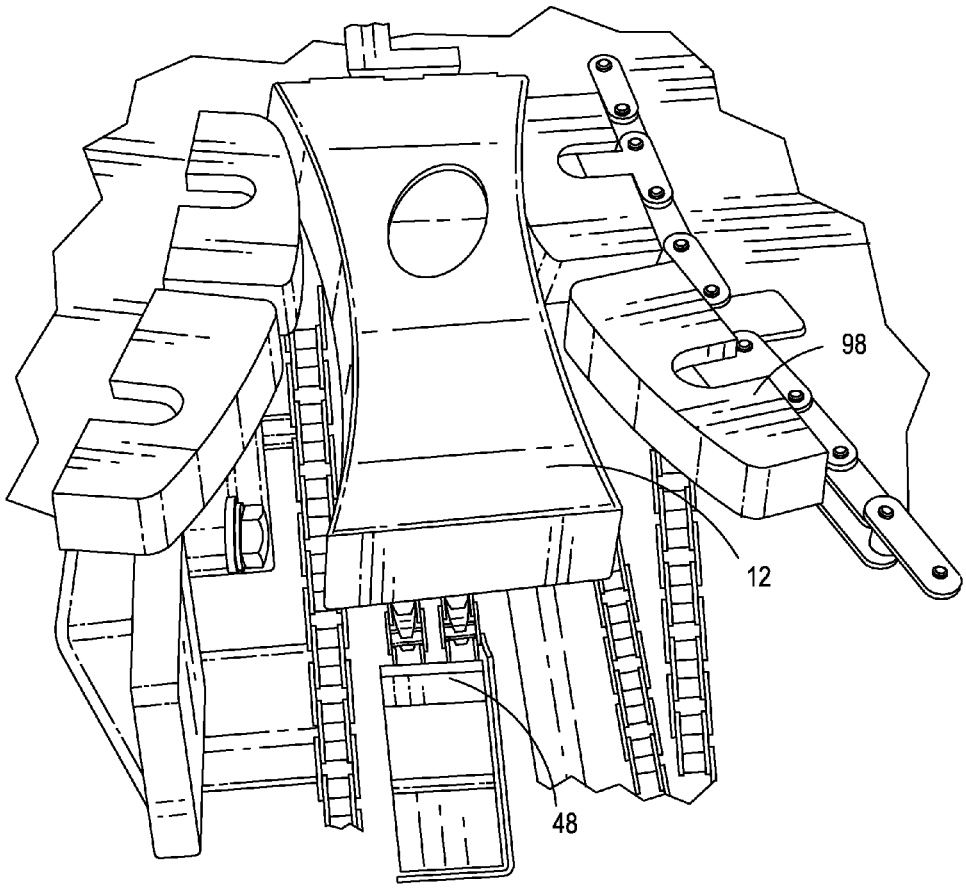

With reference to FIG. 30, the fully formed, filled carton 12 disengages from the front capture lug 48 at the far end of the cartoner 28 (See, FIG. 1). Due to the manner in which the non-rectangular rear lug 50 overlays the carton 12, it is preferable to have a conveyor meet the carton 12 as it is released by the pressure blocks 98 in order to avoid damage to the fully formed carton 12.

While the invention has been described in connection with specific embodiments and applications, the inventor does not intend to restrict the description to the examples shown. Persons skilled in the art will recognize that the above apparatus and methods may be modified or changed without departing from the general scope of the present description, the intention of the inventor being to include all such modifications and alterations in so far as they come within the scope of the appended claims or the equivalents thereof.

I claim:

1. A system for forming a carton having concave sides, comprising:

a pair of capture lugs for processing a carton blank, each of the capture lugs including lip means shaped for holding opposed ends of the carton blank and squeezing the carton blank such that the carton blank bulges when held between the capture lugs, the capture lugs being attached to a conveyor means whereby the carton blank is positioned between the capture lugs when the conveyor means moves the carton blank; and pre-breaking means positioned adjacent to the conveyor means and shaped for softening at least one curved score line along the carton blank when the carton blank is bulged between the capture lugs, the at least one curved score line corresponding to one of the concave sides of the carton, the pre-breaking means shaped for softening the curved score line for subsequent folding of a side of the carton blank along the score line to form the carton having concave sides, the pre-breaking means further comprises a plate having a gradual curved edge that supports the carton blank along the at least one curved score line of the carton blank while the carton blank is being pre-broken over the curved edge, the curved edge comprising a first and second end portions and a central portion, the first and second end portions having a curve angle which is greater than a curve angle of the central portion.

2. The system of claim 1, further comprising an elongated body having a series of spaced processing stations formed thereon, said elongated body having the conveyor means associated therewith.

3. The system of claim 2, further comprising magazine means for loading and retaining the carton blank at a first end of said elongated body, the carton blank including at least one curved score line along at least one major flap which will result in a carton having concave sides, the carton blank also including both leading and trailing minor flaps.

4. The system of claim 1, further comprising extractor means for extracting a the carton blank from a magazine means, said extractor means being adapted to extract the carton blank from said magazine means, and to place the carton blank between the pair of capture lugs for processing.

5. The system of claim 1, further comprising pressure blocks having convex surfaces, the convex surfaces being shaped to conform to the concave sides of the carton blank.

6. The system of claim 1, wherein the pre-breaking means shaped for softening at least one curved score line comprises cam and oscillator means for closing at least one major flap of the carton blank.

7. The system of claim 1, wherein each capture lug has a recessed area adapted to retain and hold respective ends of the carton blank.

8. The system of claim 1, wherein the pre-breaking means shaped for softening at least one curved score line further comprises a plurality of oscillating plates, each plate having a gradual curved edge, which support the blank while at least one curved score line of the carton blank is being pre-broken.

9. A system for forming a carton having concave sides, comprising:

an elongated body having a series of spaced processing stations formed thereon, the elongated body having a conveyor means associated therewith;

a pair of capture lugs for processing a carton blank, each of the capture lugs including lip means shaped for holding opposed ends of the carton blank and squeezing the carton blank such that the carton blank bulges when held between the capture lugs, the capture lugs being attached to the conveyor means whereby the carton blank is positioned between the capture lugs when the conveyor means moves the carton blank; and pre-breaking means positioned adjacent to the conveyor means and shaped for softening at least one curved score line along the carton blank when the carton blank is bulged between the capture lugs, the at least one curved score line corresponding to one of the concave sides of the carton, the pre-breaking means shaped for softening the curved score line for subsequent folding of a side of the carton blank along the score line to form the carton having concave sides, the pre-breaking means further comprises a plate having a gradual curved edge that supports the carton blank along the at least one curved score line of the carton blank while the carton blank is being pre-broken over the curved edge, the curved edge comprising a first and second end portions and a central portion, the first and second end portions having a curve angle which is greater than a curve angle of the central portion.

10. The system of claim 9, wherein the pre-breaking means shaped for softening at least one curved score line comprises cam and oscillator means for closing at least one major flap of the carton blank.

11. The system of claim 9, wherein the pre-breaking means shaped for softening at least one curved score line further comprises a plurality of oscillating plates, each plate have a gradual curved edge, which support the blank while at least one curved score line of the carton blank is being pre-broken.

12. The system of claim 9, further comprising pressure blocks having convex surfaces, the convex surfaces being shaped to conform to the concave sides of the carton blank.

13. The system of claim 9, wherein each capture lug has a recessed area adapted to retain and hold respective ends of the carton blank.

14. The system of claim 9, further comprising extractor means for extracting a the carton blank from a magazine means, said extractor means being adapted to extract the carton blank from said magazine means, and to place the carton blank between the pair of capture lugs for processing.

* * * * *